United States Patent [19]

Meyers

[11] Patent Number: 4,527,689

[45] Date of Patent: Jul. 9, 1985

[54] METHOD AND APPARATUS FOR MOUNTING CLIPS

[76] Inventor: Jonathan H. Meyers, 140 Riverside Dr., New York, N.Y. 10024

[21] Appl. No.: 561,826

[22] Filed: Dec. 15, 1983

Related U.S. Application Data

[63] Continuation-in-part of Ser. No. 513,244, Jul. 14, 1983, Pat. No. 4,465,186.

[51] Int. Cl.[3] ..... B65D 77/30; B65D 85/24; B65D 85/62

[52] U.S. Cl. ..... 206/342; 206/493; 206/499; 24/67.9

[58] Field of Search ..... 206/342, 493, 499, 337, 206/577, 338; 24/67.9, 255 GP

[56] References Cited

U.S. PATENT DOCUMENTS

| | | | |
|---|---|---|---|
| 1,720,295 | 7/1929 | Schwartzman . | |
| 2,008,539 | 7/1935 | Begle | 206/493 |
| 2,370,417 | 2/1945 | Preston | 206/493 |
| 2,610,654 | 9/1952 | Ahlstrand | 206/493 |
| 2,860,769 | 11/1958 | Waller | 206/577 |
| 3,462,803 | 8/1969 | Horton | 24/150 |
| 3,797,076 | 3/1974 | Watkin | 24/255 GP |
| 4,170,299 | 10/1979 | Clements | 206/342 |

FOREIGN PATENT DOCUMENTS 1228878 9/1960 France .

*Primary Examiner*—William T. Dixson, Jr.
*Attorney, Agent, or Firm*—James & Franklin

[57] ABSTRACT

Aligned sets of clips with elongated openings are received on pairs of spaced substantially parallel elements extending from a base. Each of the clip receiving elements has removably mounted thereto a member which serves to prevent rotation of the clips during mounting. The clips are encircled by a band which passes through opposing indentations in the base. After banding, the rotation preventing members are removed by breaking the connecting parts which mount same to the clip receiving elements.

13 Claims, 6 Drawing Figures

METHOD AND APPARATUS FOR MOUNTING CLIPS

The present invention is a continuation-in-part of my U.S. patent application Ser. No. 513,244 filed July 14, 1983 Pat. No. 4,465,186 and entitled: "Holder For Clips".

The present invention relates to a method and apparatus for packaging plastic clips and, more particularly, to a method and structure which stabilizes the clips prior to banding, simplifying the clip mounting operation and reducing the weight of the package during shipment.

Plastic clips of the type which the present invention relates are sometimes referred to as "tie-back" clips and have substantially "U"-shaped bodies. Such clips are commonly composed of molded plastic material and may be provided with internal serrated edges to enhance the ability to grip an article. The clips are often provided in pairs connected to each other by an elastic or non-elastic string-like member. The ends of the string-like member are usually formed in loops and each loop passes through the elongated opening of a different clip in the pair.

The clip pairs are used for a wide variety of different applications including the display, sale, and packaging of softgoods such as clothing and the like. Commonly, the clips are used to attach related articles to each other. For example, pairs of gloves, bathing suit tops and bottoms, or matching blouses and skirts may be connected and sold in this manner.

Clips of this type are a low priced item and must, therefore, be manufactured, packaged, and shipped as inexpensively as possible. Accordingly, any packaging for the clips must itself be low in cost. In order to avoid increased shipping costs, the packaging should not add substantially to the weight or bulk of the item.

Aside from cost and weight considerations, packaging of clip pairs of this type presents certain problems due to the tendency of the interconnecting string-like members to become entangled. If the clip pairs are simply placed randomly in a carton, the string-like connecting members often become so entangled with each other that it becomes virtually impossible to remove the clip pairs from the carton one at a time. For this reason, various packaging techniques have been utilized in an attempt to prevent tangling and, thus, facilitate the use of this item.

One such packaging method has been to align clips in side-by-side relation so as to form an assembly and, thereafter, wrap the assembly in heat-shrinkable plastic or the like. While this method stabilizes the individual clips during shipment, it has a disadvantage in that when the plastic wrapping is removed, the clips will fall randomly into a group and will then tangle as each clip pair is removed from the group.

An improvement on the above packing method employs a pair of parallelly situated bars or the like. A group of clips is aligned such that one of the bars can be passed through the openings therein. Groups of aligned clips, with the bars inserted therein, are then placed in side-by-side relation and wrapped. While this method also stabilizes the clips during shipping, when the wrapping is removed, the groups of clips fall apart, are difficult to remove individually from the inserted bars, and still become entangled to some extent.

An attempt to further improve upon the above methods is disclosed in U.S. Pat. No. 4,170,299 issued Oct. 9, 1979 to Alan Clements and entitled: "Rack and Tie-Back Clip Assembly". That patent teaches a rack which includes an end plate and a pair of spaced bars mounted to the plate. Each of the bars is manufactured separately from the plate and thereafter loosely mounted to the plate in a manner which permits the bars to move through a limited arc relative to the plate. A group of aligned clips is received over each of the bars by inserting the bar through the openings in the clips. The cross-sectional shape of the bar corresponds roughly to the shape of the openings in the clips so as to reduce rotation of the clips relative to the bar. The groups of clips are situated adjacent each other on the plate and a rubber band or the like is wrapped around the clip and the plate during shipping.

In actual usage, it has been found that the rack of the above-mentioned U.S. Pat. No. 4,170,299 has several disadvantages. The disadvantages relate to the bars which are shaped to prevent rotation of the clips relative to the plate. In order to insure that the clips do not rotate relative to the plate, the bars must have a cross-sectional shape which roughly corresponds to the elongated openings in the clips. In order to form the bars in the required shape, it is necessary to mold the bars separately from the plate and, thereafter, attach the bars to the plate in a separate operation. This results in bars which are not joined tightly to the plate, but which can move through a limited arc with respect thereto.

Moreover, molding the bars with this configuration utilizes a relatively large amount of plastic material, thereby adding to the weight of the holder. The additional weight of the holder results in increased shipping costs.

The relatively heavy bars are shipped with the clips even though the rotation preventing function of the bars is required only during the initial stages of the packaging operation, that is, prior to the banding of the clips. Once the clips are banded to the plate, the band itself prevents rotation of the clips relative to the plate. Thus, although the added weight of the bars provides no function after banding, same cannot be removed prior to shipping with the configuration of the holder described in the above-mentioned patent.

It is therefore, a prime object of the present invention to provide a method and apparatus for mounting clips wherein the weight of the apparatus is at a minimum during shipment.

It is, another object of the present invention to provide a method and apparatus for mounting clips wherein the apparatus can be injection molded in a single operation.

It is another object of the present invention to provide a method and apparatus for mounting clips wherein no assembly operation is required for the apparatus.

It is another object of the present invention to provide a method and apparatus for mounting clips wherein the rotation preventing function is provided during the initial stages of the mounting operation and the members which provide this function are thereafter removed to reduce the shipping weight.

It is another object of the present invention to provide a method and apparatus for mounting clips which utilizes an apparatus which is simple, inexpensive, and light in weight.

It is another object of the present invention to provide a method and apparatus for mounting clips wherein the apparatus is composed of an inexpensive preferably injection molded plastic part.

In accordance with one aspect of the present invention, a method is provided for mounting clips of the type having elongated openings on a base. The base includes spaced substantially parallel clip retaining means extending therefrom. The method comprises the steps of fabricating each of the clip retaining means to comprise an elongated clip receiving element, one end of which is fixedly mounted to the base and a rotation preventing member removably mounted to the element in substantially parallel relation thereto. Sets of aligned clips are mounted on each of the clip retaining means by inserting same through the clip openings. The clip sets and the base are encircled with a band to maintain the clips on the base. After banding, the rotation preventing members are removed.

Preferably, the base has an indentation along the side thereof. The step of encircling preferably comprises the step of placing the band in the indentation. In this manner, the location of the band with respect to the base is fixed.

In accordance with another aspect of the present invention, apparatus is provided for mounting clips of the type having elongated openings. The apparatus comprises a base, and first and second clip retaining means extending from the base in substantially parallel relation. Each of the clip retaining means comprises an elongated element, one end of which is fixedly mounted to the base. A rotation preventing member also forms a portion of each of the clip retaining means. Means are provided for removably mounting the rotation preventing member to the elongated element in substantially parallel relation.

The rotation preventing member is preferably mounted to the element in spaced relation. The mounting means preferably comprises first and second spaced connecting means. The connecting means are designed so that they can be relatively easily broken so as to remove the rotation preventing means from the apparatus prior to shipping.

The base preferably has an indentation on the side thereof. The apparatus further comprises a band encircling the clips and the base. The band is preferably positioned in the indentation.

The base has a substantially oval configuration. First and second indentations are aligned along the side of the base. Preferably, the band is positioned in both of the indentations.

The base has a major axis. The clip retaining means preferably located on opposite sides of the major axis. The base also has a minor axis. The indentations are preferably situated on the minor axis.

To these and to such other objects which may hereinafter appear, the present invention relates to a method and apparatus for mounting clips, as described in detail in the following specification and recited in the annexed claims, taken together with the accompanying drawings, wherein like numerals refer to like parts, and in which:

Figure 2:
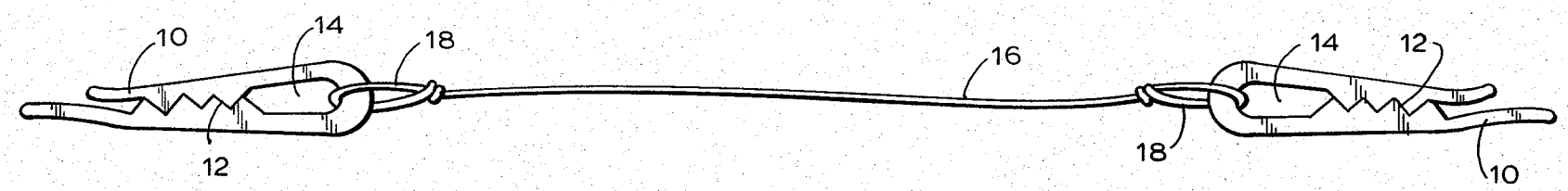
FIG. 2 is a top view of a pair of interconnected clips of the type to which the present invention relates.

As shown in FIG. 2, the clips 10, which the apparatus of the present invention is designed to hold, have substantially "U"-shaped bodies with internal serrated edges 12. The body defines an opening 14 having a substantially elongated configuration. The clips 10 are joined by an elastic or non-elastic string-like member 16 which has a loop 18 at each end. Each of the clips 10 is passed through a different one of the loops 18 such that a clip pair is formed.

Figure 1:
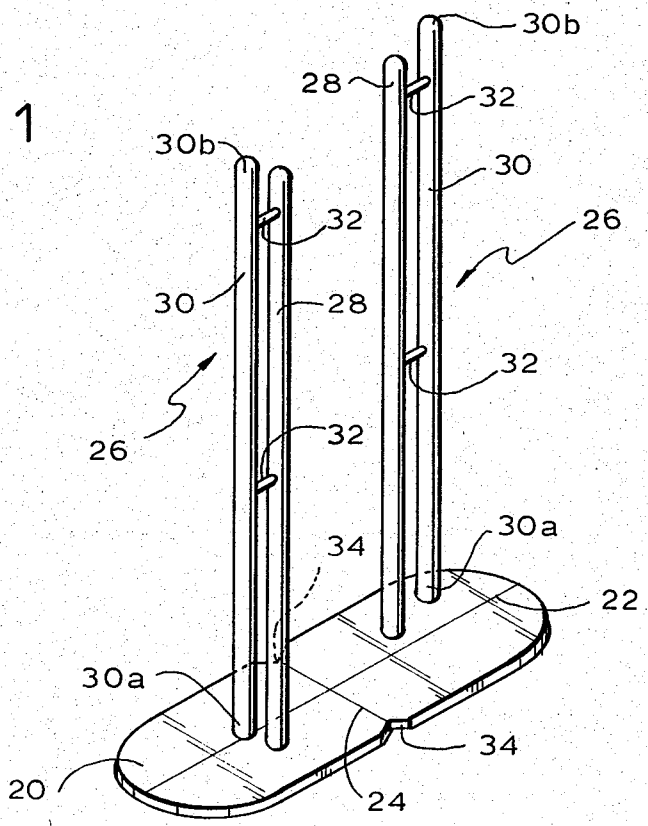
FIG. 1 is an isometric view of the apparatus of the present invention shown prior to the mounting of clips thereon.

The preferred embodiment of the apparatus of the present invention is illustrated in FIG. 1 as it would appear prior to the clip mounting operation. The apparatus includes a base 20 which is substantially planar and is illustrated as having an oval configuration. It should be understood, however, that other base shapes may be equally useful.

Base 20 has a major axis 22 and a minor axis 24. Extending upwardly from the top surface of base 20, offset from the major axis 22 in opposite directions, are a pair of substantially parallel clip retaining means 26. Each of the clip retaining means 26 comprise two parts, an elongated clip receiving element 28, and a rotation preventing member 30.

Each of the clip receiving elements 28 is elongated and has a substantially round cross-section, such that it has a rod-like configuration. One end of each of the clip receiving elements 28 is fixedly mounted to the top surface of base 20 such that the bottom portion of element 28 is retained in a substantially perpendicular position with respect to the top surface of base 20. The cross-sectional dimension of element 28 is substantially smaller than the size of openings 14 in clips 10 such that elements 28 can be easily received within openings 14 in clips 10. It should be apparent that when elements 28 are received within openings 14 of clips 10, clips 10 can freely rotate with respect to element 28 and, thus, base 20.

Each of the clip receiving elements 28 has removably connected thereto a rotation preventing member 30 which is of substantially the same shape and size as the element 28. However, the lower end **30*a* of each rotation preventing member 30 is spaced from the surface of base 20 a short distance such that the upper end 30*b* of each of the rotation preventing elements extends beyond the upper end of the clip receiving element 28 to which it is attached by a short distance. As explained below, this permits easy identification and removal of the rotation preventing member 30**.

Each rotation preventing member 30 is mounted in substantially parallel spaced relation to a clip receiving element 28 by a pair of spaced, generally parallelly extending connecting parts 32. Parts 32 are relatively small in diameter, preferably smaller than the diameter of either clip receiving elements 28 or rotation preventing members 30 so as to facilitate the breaking thereof during removal of the rotation preventing members 30.

Base 20 is preferably provided with a pair of aligned indentations 34 preferably situated along the minor axis of the base. Indentations 34 serve to position the band 36 which will encircle the base and the clips in order to maintain the clips on the base.

Clip retaining means 26, each including an element 28 mounted to base 20 and a rotation presenting member 30, mounted to the element 28, are preferably integral with base 20 and are formed along with base 20 in a single injection molding operation. Thus, the entire holder is formed at one time and no assembly is required. After removal, members 30 can be recycled for use in future molding operations.

The method of mounting the clips to the apparatus illustrated in FIG. 1 is simple and can be performed quickly by unskilled laborers. The operator holds the apparatus in one hand and mounts aligned sets of clips thereon by inserting each of the clip retaining means 26 (including an element 28 and a member 30) through the aligned openings 14 in the clips 10. Normally, one clip from each clip pair is received over each of the clip retaining means 26. However, both clips in a clip pair can be received on a single clip retaining means 26, if desired or convenient.

Figure 3:
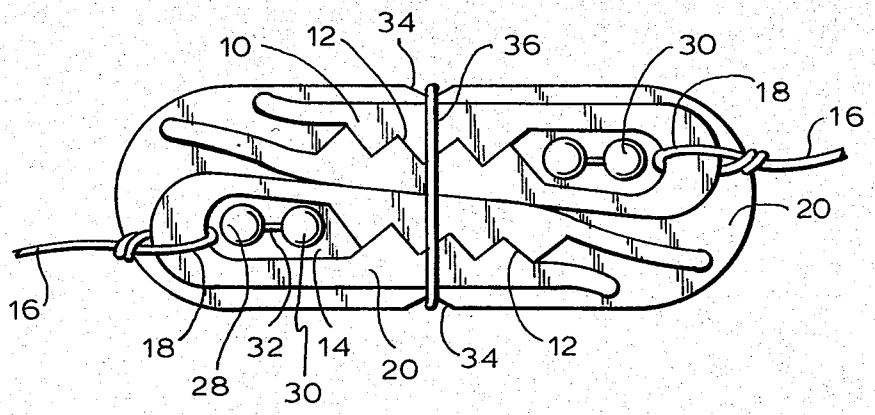
FIG. 3 is a top plan view of a preferred embodiment of the present invention showing same with the clips mounted thereon before the rotation preventing means are removed therefrom.

It should be appreciated, with reference to FIG. 3, that once the clips are received over the clip retaining means 26, they are automatically properly aligned with each other and with base 20. This is because the shape and positioning of element 28 and member 30, which form each of the clip retaining means 26, cooperates with the elongated openings 14 of each clip such that the clip can be received on the clip retaining means 26 only when it is in the proper rotational position with respect to base 20.

Figure 4:
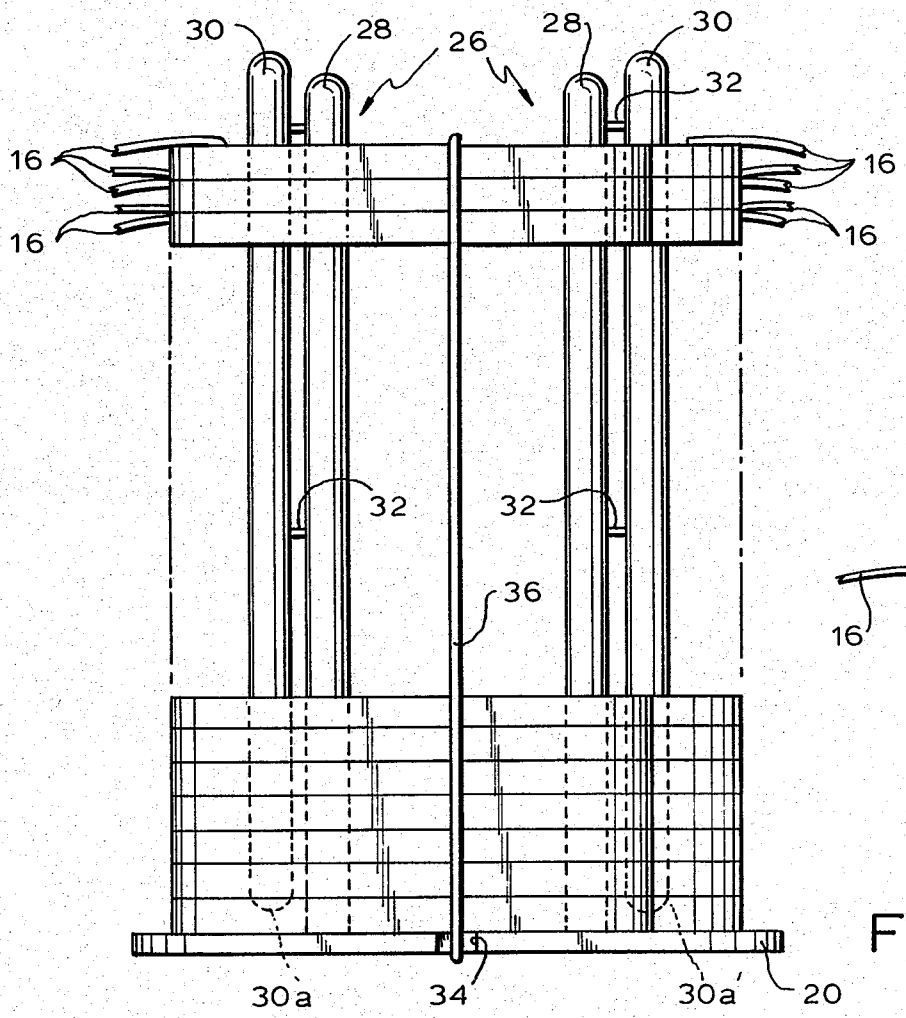
FIG. 4 is a side view of the preferred embodiment of the present invention shown in FIG. 3.

Once a full complement of clips is mounted, a band 36, such as a conventional rubberband or the like, is wrapped around the base and the bodies of the clips. The rubberband 36 is situated within indentations 34 on opposite sides of base 20 to insure proper positioning and to prevent movement of the rubberband relative to the sides of the base. The apparatus now appears as illustrated in FIGS. 3 and 4.

Figure 5:
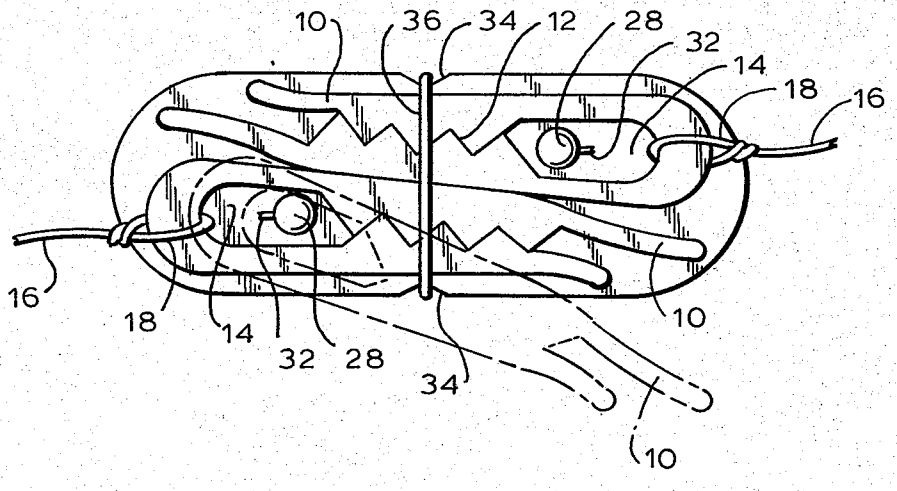
FIG. 5 is a top view similar to that shown in FIG. 3, showing the preferred embodiment of the present invention after removal of the rotation preventing means.
Figure 6:
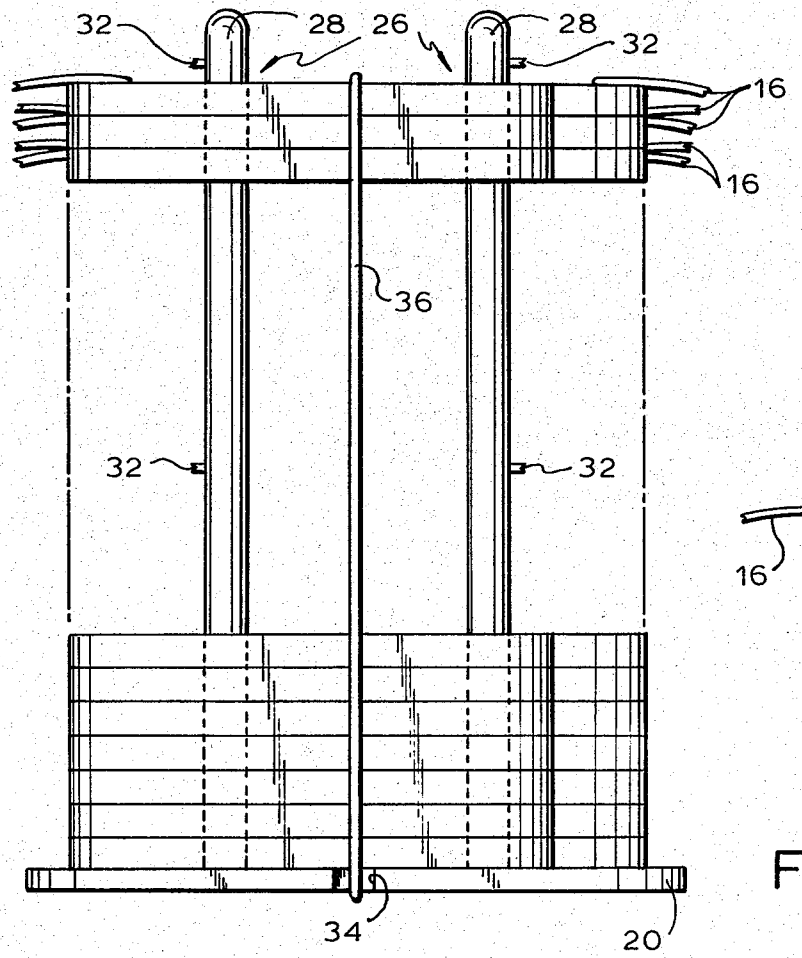
FIG. 6 is a side view of the preferred embodiment of the present invention, but showing same with the rotation preventing members removed.

The packaging operation is completed by removing each of the rotation preventing members 30, which have now completed the intended function of insuring proper alignment of the clips and preventing rotation of the clips during the banding operation. The upper end of each of the rotation preventing members 30, which is easily identified because it extends above the clip receiving element 28 to which it is mounted, is now grasped by a tool such as pliers or the like and pulled in a direction away from the surface of base 20 such that connecting parts 32 break and the rotation preventing member 30 is removed from the assembly. After removal of the rotation preventing members, the apparatus appears as shown in FIGS. 5 and 6.

It will now be appreciated that the present invention relates to a relatively simple, inexpensive apparatus which can be used to mount clips in an easy and efficient manner and which can be fabricated in its entirety by a single injection molding operation, no assembly of parts being required. Moreover, after the clips are mounted to the base and banded, the rotation preventing members can be easily removed, thereby reducing the overall weight thereof and, thus, the cost of shipping the clips. Further, the material of which the removed rotation preventing members is composed can be recycled for use in injection molding other apparatus of this type.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A method of mounting clips on a base, the clips being of the type having elongated openings, the base including spaced, substantially parallel clip retaining means extending therefrom, said method comprising the steps of:

(a) fabricating each of the clip retaining means to comprise an elongated clip receiving element, one end of which is fixedly mounted to the base and a rotation preventing member removably mounted to the element, in substantially parallel relation thereto;

(b) mounting sets of aligned clips on each of the clip retaining means by inserting same through the clip openings;

(c) encircling the clip sets and the base with a band to maintain the clips on the base; and (d) removing the rotation preventing members.

2. The method of claim 1 wherein each rotation preventing member is mounted to a clip receiving element by a connecting part and wherein the step of removing the rotation preventing members comprises the step of breaking the connecting part.

3. The method of claim 1, wherein the base has an indentation along the side thereof and wherein the step of encircling comprises the step of placing the band in the indentation.

4. Apparatus for mounting clips of the type having elongated openings, said apparatus comprising a base, first and second clip retaining means extending from said base in substantially parallel relation, each of said means comprising an elongated element, one end of which is fixedly mounted to said base, a rotation preventing member and means for removably mounting said member to said element in substantially parallel relation.

5. The apparatus of claim 4 wherein said clip retaining means are integral with said base.

6. The apparatus of claim 4 wherein the end of said rotating preventing member nearest said base is spaced from said base.

7. The apparatus of claim 4, wherein said member is mounted to said element in spaced relation.

8. The apparatus of claim 4, wherein said base has an indentation on the side thereof.

9. The apparatus of claim 8, further comprising a band encircling the clips and the base, said band being positioned in said indentation.

10. The apparatus of claim 4, wherein said base has a substantially oval configuration and first and second aligned indentations.

11. The apparatus of claim 4, wherein said base has a major axis and wherein said clip retaining means are located on opposite sides of said major axis.

12. The apparatus of claim 10, wherein said base has a minor axis and wherein said indentations are situated on said minor axis.

13. The apparatus of claim 4, wherein said mounting means comprises first and second spaced connecting means.

* * * * *